US011189477B2

(12) United States Patent
Covey et al.

(10) Patent No.: US 11,189,477 B2
(45) Date of Patent: Nov. 30, 2021

(54) APCI ION SOURCE WITH ASYMMETRICAL SPRAY

(71) Applicant: DH Technologies Development Pte. Ltd., Singapore (SG)

(72) Inventors: Thomas R. Covey, Richmond Hill (CA); Peter Kovarik, Markham (CA)

(73) Assignee: DH Technologies Development Pte. Ltd., Singapore (SG)

( * ) Notice: Subject to any disclaimer, the term of this patent is extended or adjusted under 35 U.S.C. 154(b) by 0 days.

(21) Appl. No.: 16/639,411

(22) PCT Filed: Aug. 10, 2018

(86) PCT No.: PCT/IB2018/056057

§ 371 (c)(1),
(2) Date: Feb. 14, 2020

(87) PCT Pub. No.: WO2019/034978

PCT Pub. Date: Feb. 21, 2019

(65) Prior Publication Data

US 2021/0134579 A1 May 6, 2021

Related U.S. Application Data

(60) Provisional application No. 62/546,982, filed on Aug. 17, 2017.

(51) Int. Cl.

| | |
|---|---|
| ***H01J 49/16*** | (2006.01) |
| ***H01J 49/04*** | (2006.01) |
| ***H01J 49/14*** | (2006.01) |

(52) U.S. Cl.
CPC ..... *H01J 49/165* (2013.01); *H01J 49/045* (2013.01); *H01J 49/049* (2013.01); *H01J 49/145* (2013.01); *H01J 49/168* (2013.01)

(58) Field of Classification Search
CPC ..... H01J 49/165; H01J 49/045; H01J 49/049; H01J 49/145; H01J 49/168
See application file for complete search history.

(56) References Cited

U.S. PATENT DOCUMENTS 5,859,432 A * 1/1999 Kato ..... H01J 49/049 250/288
6,177,669 B1 * 1/2001 Wells ..... H01J 49/049 250/288

(Continued)

FOREIGN PATENT DOCUMENTS

WO 2015019157 A1 2/2015

OTHER PUBLICATIONS

International Search Report and Written Opinion for PCT/IB2018/056057 dated Dec. 7, 2018.

*Primary Examiner* — Sean M Luck

(57) ABSTRACT

Systems and methods for atmospheric pressure chemical ionization are provided herein. In various aspects, the APCI apparatus, systems, and methods can provide an asymmetric sample spray into a vaporization chamber asymmetrically (e.g., off axis from the longitudinal axis of the vaporization chamber) so as to increase the interaction of the molecules in the sample spray with the vaporization chamber's sidewalls (and expose more of the molecules to the heat generated thereby), which can thereby result in improved consistency and/or efficiency of ion formation, and/or increased sensitivity relative to conventional APCI techniques.

20 Claims, 4 Drawing Sheets

(56) References Cited

U.S. PATENT DOCUMENTS

| | | | | |
|---|---|---|---|---|
| 6,252,225 | B1 * | 6/2001 | Takada | G01N 30/7266 250/288 |
| 6,326,616 | B1 | 12/2001 | Andrien, Jr. et al. | |
| 6,759,650 | B2 * | 7/2004 | Covey | H01J 49/049 250/282 |
| 6,949,739 | B2 * | 9/2005 | Franzen | H01J 49/16 250/281 |
| 7,145,138 | B1 * | 12/2006 | Thakur | H01J 49/145 250/288 |
| 9,230,786 | B1 * | 1/2016 | Kennedy | H01J 49/0404 |
| 2003/0189169 | A1 | 10/2003 | Wells et al. | |
| 2004/0099803 | A1 | 5/2004 | Tong et al. | |
| 2009/0294660 | A1 * | 12/2009 | Whitehouse | H01J 49/168 250/288 |
| 2010/0171033 | A1 | 7/2010 | Jolliffe et al. | |
| 2012/0325024 | A1 * | 12/2012 | Vidal-de-Miguel | G01N 27/622 73/863.24 |
| 2014/0264003 | A1 * | 9/2014 | Di Bussolo | H01J 49/168 250/282 |
| 2016/0372313 | A1 * | 12/2016 | Brown | H01J 49/0031 |
| 2017/0032949 | A1 * | 2/2017 | Covey | H01J 49/045 |

* cited by examiner

APCI ION SOURCE WITH ASYMMETRICAL SPRAY

RELATED APPLICATION

This application claims priority to U.S. provisional application No. 62/546,982 filed on Aug. 17, 2017, entitled "APCI Ion Source with Asymmetrical Sprayer," which is incorporated herein by reference in its entirety.

FIELD

The present teachings relate to methods, systems, and apparatus for generating ions from a sample (e.g., containing an analyte of interest) for mass spectrometry (MS) analysis, and particularly, to an atmospheric pressure chemical ionization device exhibiting an asymmetrical spray.

INTRODUCTION

Mass spectrometers allow detection, identification, and quantification of chemical entities in samples. Mass spectrometers detect chemical entities as ions such that a conversion of the analytes of interest to charged ions must occur during the sampling process. In one known form of ionization known as atmospheric pressure chemical ionization (APCI), sample ions are generated by ion-molecule reactions in the gas phase. In particular, APCI techniques typically exhibit the following processes: 1) a liquid sample (e.g., analyte molecules within a mobile phase such as a liquid chromatography solvent) is nebulized into a fine mist of droplets; 2) the droplets pass through a heated chamber to vaporize the droplets; 3) vaporized mobile phase molecules are charged as the hot gas mixture is discharged past a charge source to produce primary ions (e.g., of the solvent molecules); and 4) the primary ions chemically react with the sample analytes (e.g., via a proton transfer reaction) to ionize the analytes of interest. As described for example in U.S. Patent Pub. No. 20040046118, the teachings of which are incorporated by reference in its entirety, attempts to improve APCI techniques have focused on reducing the effects of incomplete vaporization of the liquid sample by disposing the APCI ion source relative to the MS sampling orifice such that non-vaporized droplets and uncharged molecules discharged from the heated chamber are not targeted directly at the sampling orifice. Instead, an electrical field within the ionization chamber guides the ions from the heated gas to the sampling orifice, thereby reducing noise in the MS data caused by the entrance of droplets.

A need nonetheless remains for APCI techniques exhibiting improved efficiency of vaporization of the solvent and sample molecules so as to increase the ionization of analytes within the sample.

SUMMARY

Apparatus, systems, and methods in accordance with the applicants' present teachings can provide for more effective desolvation and evaporation of the liquid sample in an APCI ion source. In various aspects, liquid sample can be sprayed into the vaporization chamber asymmetrically (e.g., off axis from the longitudinal axis of the vaporization chamber) so as to increase the interaction of the molecules in the sample spray with the vaporization chamber's sidewalls (and expose more of the molecules to the heat generated thereby). In certain aspects, the sample spray can be aimed to intersect the sidewall of the vaporization chamber and generate a spiral path of the heated gas along the sidewall to the vaporization chamber's exit. The spiral nature of the flow, for example, can cause the vaporized molecules to exit asymmetrically from the heated chamber (e.g., preferentially on one side of the axis of the chamber), yet remain collimated and localized near the wall in a small section of the chamber's exit aperture. In such aspects, the positioning of the charge source (e.g., corona discharge needle) can be optimized to enhance the ionization efficiency. In some aspects, an additional entrainment flow can be added to eliminate back streaming of the sample. The asymmetrical introduction of the sample spray can enhance a spiral path formation of the plume through the heater via the Coanda effect, which can increase the exposure to the heated sidewall due to the tendency of a gas flow to follow a surface upon which it impinges. This effect can be further aided by the addition of the entrainment flow.

In accordance with various aspects of the present teachings, an APCI source for a mass spectrometer is provided, the APCI source comprising a heated vaporization tube defining a lumen extending from an inlet end to an outlet end along a central longitudinal axis, the outlet end of the tube configured to be disposed within an ion source housing in fluid communication with a sampling orifice of a mass spectrometer. A sampling probe extends from an inlet end configured to receive a liquid sample comprising solvent molecules and sample molecules to an outlet end disposed within the lumen of the heated vaporization tube between the inlet and outlet end thereof. The outlet end of the sampling probe is configured to discharge the liquid sample into a sample spray exhibiting a central axis that is not coaxial with the central longitudinal axis of the lumen, and the heated vaporization tube is configured to vaporize at least a portion of said solvent molecules and sample molecules as the sample spray traverses the lumen toward the outlet end thereof. The APCI source can also include a charge source (e.g., a corona discharge needle) disposed adjacent to the outlet end of the vaporization tube that is configured to apply an electric charge to the vaporized solvent molecules and sample molecules as said vaporized solvent molecules and sample molecules exit from the outlet end of the heated vaporization tube into the ion source housing so as to ionize the sample molecules within the ion source housing.

In some aspects, the central axis of the sample spray can be offset from and substantially parallel to the central longitudinal axis of the lumen. Additionally or alternatively, in various aspects, the central axis of the sample spray can intersect the heated vaporization tube. In some aspects, for example, a gas source configured to provide a gas flow about the sampling probe to direct the liquid sample discharged from the sampling probe toward an inner sidewall of the heated vaporization tube.

The sampling probe can have a variety of configurations for generating the sample spray within the heated vaporization tube. In various aspects, the outlet end of the sampling probe can be configured to nebulize the liquid sample. For example, in some aspects, the sampling probe can comprise a liquid conduit having an outlet end for discharging the liquid sample and a gas sheath or conduit at least partially surrounding the liquid conduit for providing a nebulizing gas about the liquid sample discharged from the outlet end of the liquid conduit. In some related aspects, at least the outlet end of the liquid conduit can extend along a longitudinal axis that intersects a sidewall of the heated vaporization tube.

The vaporization tube can have a variety of configurations and can be made of a variety of materials. For example, the vaporization tube can exhibit a circular, elliptical, or polygonal cross-sectional shape. In some aspects, the inner sidewalls of the vaporization tube can be in the form of a spiral. In some exemplary aspects, the vaporization tube can be formed of ceramic materials or glass. In various aspects, the vaporization tube can be coupled to a heater so as to maintain the vaporization tube at a temperature in a range of about 100° C. to about 750° C. In some aspects, the heated vaporization tube and the sampling probe can be configured such that the vaporized solvent molecules and sample molecules preferentially exit the heated vaporization tube from a side of the lumen's central longitudinal axis. In related aspects, the charge source can be disposed adjacent to the distal end of the vaporization tube on said side from which said vaporized solvent molecules and sample molecules preferentially exit.

In accordance with various aspects of the present teachings, a method of ionizing sample molecules within a liquid sample is provided, the method comprising discharging a liquid sample from an outlet end of a sampling probe into a lumen of a heated vaporization tube, wherein the lumen of the heated vaporization tube extends along a central longitudinal axis and wherein the liquid sample is discharged as a sample spray exhibiting a central axis that is not coaxial with the central longitudinal axis of the lumen. At least a portion of solvent molecules and sample molecules within the liquid sample can be vaporized as the sample spray traverses the lumen toward an outlet end of the heated vaporization tube, and an electrical charge can be applied to at least one of the vaporized solvent molecules and sample molecules as they exit the outlet end of the heated vaporization tube into an ionization chamber such that the sample molecules are ionized within the ionization chamber. Thereafter, the ionized sample molecules can be transmitted from the ionization chamber into a sampling orifice of a mass spectrometer and mass spectrometric analysis of the ionized sample molecules can be performed.

In some aspects, the ionization chamber can be maintained at substantially atmospheric pressure. In various aspects, the sampling probe can be configured to nebulize the liquid sample. In some aspects, the method can comprise maintaining the heated vaporization tube at a temperature in a range of about 100° C. to about 750° C.

In accordance with various aspects, the central axis of the sample spray as the sample spray exits the sampling probe can be offset from and substantially parallel to the central longitudinal axis. Alternatively, in some aspects, the central axis of the sample spray as the sample spray exits the sampling probe can intersect the heated vaporization chamber. In related aspects, a gas flow can be provided between an outer surface of the sampling probe and an inner wall of the heated vaporization tube, wherein the gas flow is configured to maintain the liquid sample discharged from the sampling probe toward the inner wall of the heated vaporization tube on the side of the central longitudinal axis on which the sample spray is offset and to prevent back streaming of the sample.

In some aspects, the vaporized solvent molecules and sample molecules can preferentially exit the heated vaporization tube from one side of the lumen's central longitudinal axis. In some related aspects, the electrical charge can be applied by a charge source disposed adjacent to the outlet end of the vaporization tube on said side from which said vaporized solvent molecules and sample molecules preferentially exit from the heated vaporization tube.

Further understanding of the invention can be obtained by reference to the following detailed description in conjunction with the associated drawings, which are described briefly below.

BRIEF DESCRIPTION OF THE DRAWINGS

A skilled person in the art will understand that the drawings, described below, are for illustration purposes only. The drawings are not intended to limit the scope of the applicant's teachings in any way.

DETAILED DESCRIPTION

Those skilled in the art will understand that the methods, systems, and apparatus described herein are non-limiting exemplary embodiments and that the scope of the applicants' disclosure is defined solely by the claims. While the applicants' teachings are described in conjunction with various embodiments, it is not intended that the applicants' teachings be limited to such embodiments. To the contrary, the applicants' teachings encompass various alternatives, modifications, and equivalents, as will be appreciated by those of skill in the art. The features illustrated or described in connection with one exemplary embodiment may be combined with the features of other embodiments. Such modifications and variations are intended to be included within the scope of the applicants' disclosure.

Figure 1:
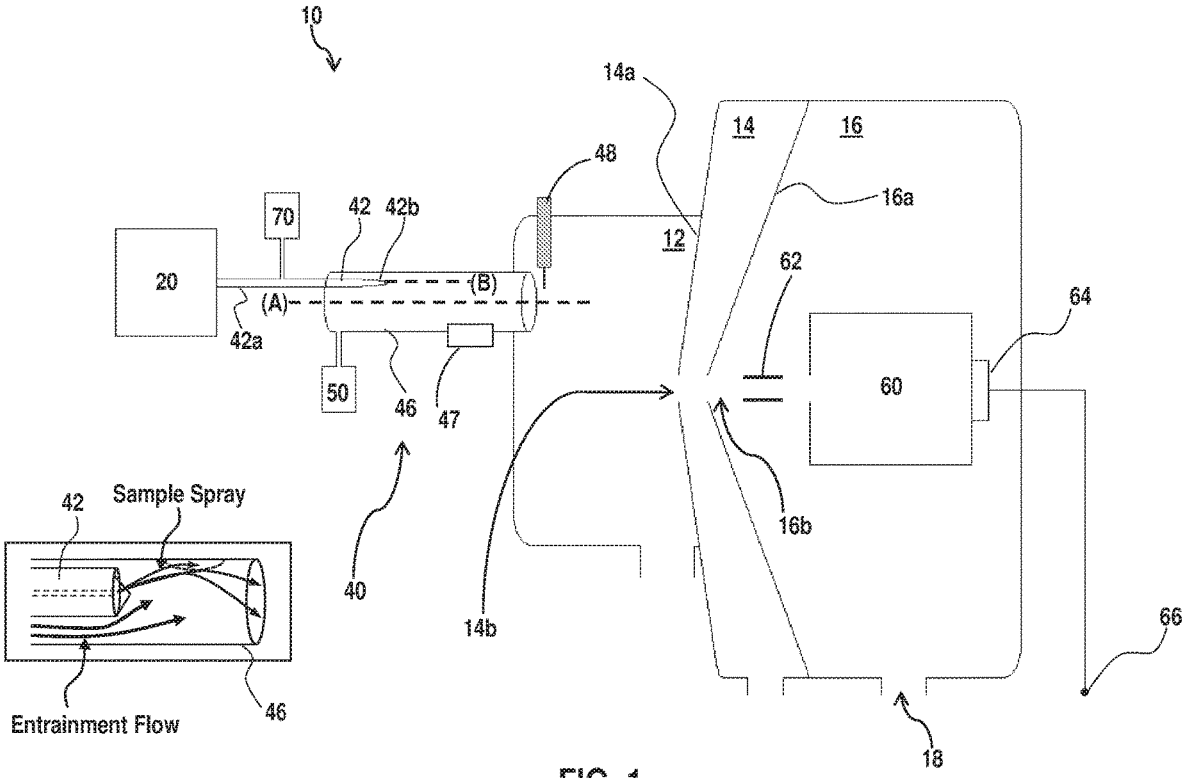
FIG. 1, in schematic diagram, illustrates an exemplary embodiment of a system for delivering a sample to a mass spectrometer according to various aspects of the applicant's teachings.

APCI apparatus, systems, and methods in accordance with various aspects of the applicants' present teachings can result in improved consistency and/or efficiency of ion formation, and/or increased sensitivity relative to conventional APCI techniques. FIG. 1 schematically depicts an exemplary embodiment of a mass spectrometer system 10 in accordance with various aspects of the present teachings for generating sample ions using atmospheric pressure chemical ionization of a liquid sample and delivering the sample ions to a sampling orifice of a mass spectrometer. As shown in FIG. 1, the mass spectrometer system 10 generally includes a source 20 of a liquid sample (e.g., analytes of interest within a fluid such as a HPLC solvent) and an APCI ion source 40 for discharging vaporized sample molecules into an ion source housing 12 in fluid communication with a mass analyzer 60. A charge source (e.g., a corona discharge needle 48) is disposed adjacent the entrance of the vaporized sample molecules into the ion source housing 12 for ionization of sample molecules prior to entering the inlet orifice of the mass spectrometer.

The APCI ion source 40 is generally configured to ionize sample analytes of interest, e.g., via a chemical reaction and/or a charge transfer reaction with other ions following discharge into the ion housing 12. Generally, within the APCI source 40 the liquid sample is discharged (e.g., into a mist comprising a plurality of droplets) within a vaporization tube composed of glass, ceramic, or other suitable materials, which can be subject to controlled heating through association with one or more heating devices. Within the vaporization tube, which can have a length of several inches by way of non-limiting example, droplets of the sample spray are exposed to heat such that the droplets are vaporized. The charge source (e.g., corona discharge needle 48) can create a corona discharge in the ambient atmosphere such that when the hot jet of gas from the vaporization chamber enters the corona discharge region some of the vaporized sample molecules can be ionized.

As shown, the exemplary APCI ion source 40 comprises a sampling probe 42 extending from an inlet end 42*a* to an outlet end 42*b* configured to atomize, aerosolize, nebulize, or otherwise discharge (e.g., spray with a nozzle) the liquid sample into the lumen of a heated vaporization tube 46. For example, as discussed below with reference to FIGS. 2A-F, the sampling probe 42 can comprise a sheath 44, within which a fluid conduit 43 for delivering the fluid sample to the outlet end 42*b* of the sampling probe 42 extends. In this manner, a channel between an inner wall of the sheath and an outer wall of the fluid conduit can be coupled to a source 70 of pressurized gas (e.g. nitrogen, air, or a noble gas) for supplying a nebulizing gas flow which surrounds the outlet end of the fluid conduit and interacts with the fluid discharged therefrom to enhance the formation of the sample spray from the sampling probe's outlet end 42*b*, e.g., via the interaction of the high speed nebulizing flow and the jet of liquid sample. The nebulizer gas can be supplied at a variety of flow rates, for example, in a range from about 0.1 L/min to about 20 L/min. Thus, as will be appreciated by a person skilled in the art in light of the present teachings, the outlet end 42*b* of the sampling probe 42 can discharge a mist or plume comprising the nebulizing gas flow and a plurality of micro-droplets of the liquid sample generally along a discharge axis (B).

As discussed otherwise herein, in accordance with various aspects of the present teachings the depicted vaporization tube 46 extends along a central longitudinal axis (A), with the sampling probe 42 being arranged such that the central axis (B) of the liquid sample discharged into the vaporization tube 46 is not coaxial with the central longitudinal axis (A) of the vaporization tube. In various aspects, this asymmetric sample spray can increase the interaction of the molecules in the sample spray with the heated vaporization tube's sidewalls, thereby leading to increased vaporization of molecules within the sample spray. The applicant has found, for example, that optimization of known APCI sources (e.g., a Turbo V APCI ion source of SCIEX) demonstrates a rapid signal drop off beyond about 550° C., thus suggesting a lack of heat penetration into the core of the plume. Without being bound by any particular theory, it is believed that known devices tend to interrogate only the periphery of the sample spray, with smaller droplets being subjected to overheating. However, systems in accordance with various aspects of the present teachings have been shown to demonstrate as much as a factor of 6 increase in peak intensity, with the total ions detected (e.g., the area of an XIC) being more than 10× a standard APCI source.

In accordance with various aspects of the present teachings, as shown in FIG. 1, the sample spray can be discharged along an axis that is offset from but substantially parallel to the central longitudinal axis (A) of the vaporization tube 46. Because of the fluid dynamics within the vaporization chamber, and in some aspects, because of the provision of an additional entrainment flow of gas about the sampling probe 42 within the vaporization tube 46 provided by a gas source 50, back streaming of the discharged liquid sample can be prevented and can cause the discharged fluid to be preferentially maintained against the sidewall of the vaporization tube 46 on the side of the spray's axis (B). Additionally or alternatively to the sampling probe 42 itself being disposed offset but parallel to the central longitudinal axis (A), in various aspects, the sampling probe 42 can be aimed to discharge the sample spray such that the discharge axis (B) intersects the sidewall of the vaporization tube 46 and to generate a path of the heated gas, which may follow a curve or a spiral, along the sidewall to the vaporization tube's exit such that vaporized molecules exit asymmetrically in a small section of the tube's exit aperture, as schematically depicted in the inset of FIG. 1. In certain aspects, the charge source (e.g., corona discharge needle 48) can be positioned adjacent the discharge end of the vaporization tube 46 at a location where the vaporized stream of sample analytes and solvent molecules preferentially exit into the ion source housing 12, thereby further enhancing the ionization efficiency of the APCI source 40.

As will be appreciated by a person skilled in the art, the system 10 can be fluidly coupled to and receive a liquid sample from a variety of liquid sample sources. By way of non-limiting example, the sample source 20 can comprise a reservoir of the sample to be analyzed or an input port through which the sample can be injected (e.g., manually or via an auto-sampler). Alternatively, also by way of non-limiting example, the liquid sample to be analyzed can be in the form of an eluent from a liquid chromatography column.

As shown in FIG. 1, the mass spectrometry system 10 can include one or more chambers 14, 16 within which the ions generated by the APCI ion source 40 can be received and/or processed. By way of example, in the depicted embodiment, the ion source housing 12 can be separated from a gas curtain chamber 14 by a plate 14*a* having a curtain plate aperture 14*b*. In this manner, the ions generated within the ion source housing 12 can be attracted toward the curtain plate aperture 14*b* due to the electric fields created by the voltages applied to various components of the system, as is known in the art. By way of example, analyte ions can be electrostatically attracted to a complementary (either positive or negative) charge from a voltage source (not shown) applied to the curtain plate 14*a* to the mass analyzer 60. As shown, a vacuum chamber 16, which houses the mass analyzer 60, is separated from the curtain chamber 14 by a plate 16*a* having a vacuum chamber sampling orifice 16*b*. The ionization chamber 12 can be maintained at an atmospheric pressure, though in some embodiments, the ionization chamber 12 can be evacuated to a pressure lower than atmospheric pressure. The curtain chamber 14 and vacuum chamber 16 can be maintained at selected pressure(s), for example, by evacuation of chamber 16 through vacuum pump port 18. Ions generated by the ion source 40 in the ionization chamber 12 can thus be drawn through orifices 14*b*, 16*b* positioned generally along the axis of the mass spectrometer system 10 and can be focused (e.g., via one or more ion lens 62) into the mass analyzer 60.

The mass analyzer 60 can have a variety of configurations but is generally configured to process (e.g., filter, sort, dissociate, detect, etc.) sample ions generated by the ion source 40. By way of non-limiting example, the mass analyzer 60 can be a triple quadrupole mass spectrometer, or any other mass analyzer known in the art and modified in accordance with the teachings herein. It will further be appreciated by a person skilled in the art in light of the present teachings, that a detector 64 at the end of the mass analyzer 60 can detect the ions which pass through the analyzer 60 and can, for example, supply a signal at terminal 66 indicative of the number of ions per second that are detected.

As shown in FIG. 1, the exemplary ion source 40 additionally includes one or more heaters 47 for heating the vaporization tube 46 to promote desolvation of the liquid sample (e.g., solvent molecules and analytes of interest) within the sample spray discharged therein. The heater 47 can have a variety of configurations but is generally to maintain the temperature of the vaporization tube 46 to a temperature sufficient to substantially vaporize the liquid sample sprayed therein. By way of example, the heater(s) 47 can comprise one or more heating elements (e.g., heating coils) to directly heat. By way of non-limiting example, the heater(s) 47 can be effective to maintain the vaporization tube at a temperature in a range of from about 100° C. to about 800° C. As will be appreciated by a person skilled in the art, a temperature of the vaporization tube 46 can be monitored (e.g., via a thermistor) and the temperature thereof can be regulated so as to control modification of the vaporization rate. As will be appreciated by a person skilled in the art, because of the differences between the energy required to vaporize different liquids, the temperature of the vaporization tube 46 can be selected so as to optimize vaporization of the liquid sample.

Figure 2A:
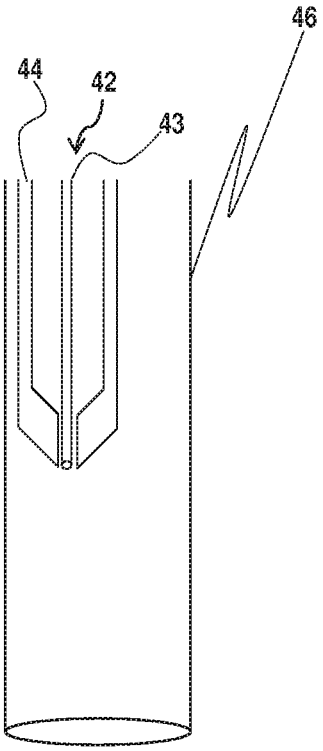
FIGS. 2A-F, in schematic diagram, illustrate exemplary APCI sources in accordance with various aspects of the present teaching for providing an asymmetric sample spray within a vaporization chamber.

With reference now to FIGS. 2A-F, exemplary configurations in accordance with various aspects of the present teaching for providing an asymmetric sample spray within the vaporization chamber of an APCI source are depicted. In particular, FIG. 2A depicts a sampling probe 42 in which a fluid conduit 43 extends through an outer conduit or sheath 44. The channel formed between an inner wall of the sheath 44 and an outer wall of the fluid conduit 43 can be coupled to a nebulizer gas source (not shown) so as to surround the outlet end of the fluid conduit 43 with a nebulizing gas flow to enhance the formation of the sample spray into the vaporization tube 46. It will be appreciated in light of the present teachings that though the axis of the sample spray discharged from the sampling probe 42 of FIG. 2A would be substantially parallel to the central longitudinal axis of the vaporization tube 46, the sample spray is nonetheless asymmetric relative thereto due to the off-axis disposition of the sampling probe 42.

Figure 2B:
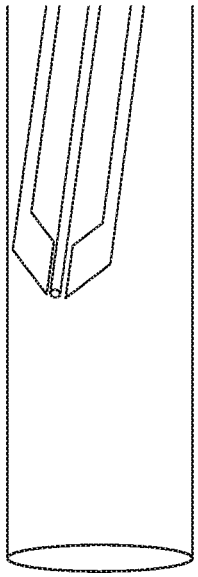

With reference now to FIG. 2B, another exemplary configuration for generating an asymmetric sample spray in accordance with various aspects of the present teachings is depicted. The APCI source of FIG. 2B is substantially similar to that of FIG. 2A, but differs in that the sampling probe 42 is disposed at a non-parallel angle relative to the central longitudinal axis of the vaporization tube 46 such that the sample spray is directed about an axis that intersects the sidewall of the vaporization tube 46 such that a greater portion of the sample spray is directed thereat.

Figure 2C:
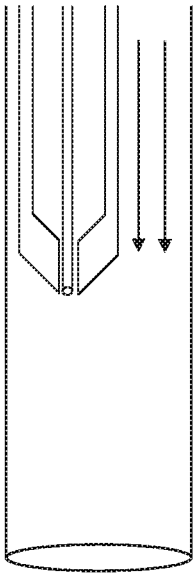

With reference now to FIG. 2C, another exemplary configuration for generating an asymmetric sample spray in accordance with various aspects of the present teachings is depicted. The APCI source of FIG. 2C is substantially similar to that of FIG. 2A, but differs in that the sampling probe 42 additionally is coupled to an entrainment gas flow source (e.g., source 50 of FIG. 1) that is configured to provide an entrainment flow that further promotes the asymmetric flow of the sample spray within the chamber and/or prevents back-streaming of the sample spray within the vaporization tube 46. The entrainment gas can be supplied at a variety of flow rates, for example, in a range from about 0.1 L/min to about 20 L/min.

Figure 2D:
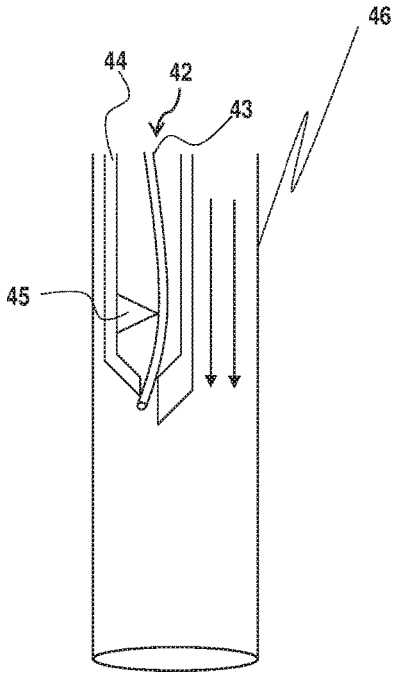

With reference now to FIG. 2D, another exemplary configuration for generating an asymmetric sample spray in accordance with various aspects of the present teachings is depicted. The APCI source of FIG. 2D is substantially similar to that of FIG. 2B in that the sampling probe 42 is configured to discharge the sample spray at a non-parallel angle relative to the central longitudinal axis of the vaporization tube 46 (e.g., the central axis of the sample spray intersects the sidewall of the vaporization tube 46), though the central axis of the sampling probe's sheath 44 is parallel to the central longitudinal axis of the vaporization tube 46. By way of example, a dimple 45 formed on an inner sidewall of the sheath 44 can deflect the fluid conduit 43 such that the spray axis from the distal end thereof is directed at the sidewall of the vaporization tube. In various aspects, the distal end of the sheath 44 can further be configured to be asymmetric about the longitudinal axis of the sampling probe 42 such that the fluid conduit 43 tends to discharge the sample liquid toward the direction of the dimple 45 relative to the central axis. Additionally, as noted above with respect to FIG. 2C, an entrainment flow (as indicated by the arrows) can be provided to further promote increased interaction of the sample spray with the vaporization tube 46.

Figure 2E:
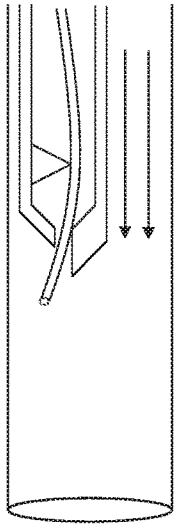

With reference now to FIG. 2E, in some aspects, the fluid conduit 43 can be configured to be axially actuated such that the conduit can be extended or retracted along its axis. Comparing FIG. 2D and FIG. 2E, for example, the fluid conduit 43 of FIG. 2E is axially extended relative to that of FIG. 2D. Because of the shape of the distal end of the sheath 43 and the location of the dimple 45, axial actuation of the fluid conduit 43 can be effective to reduce the distance between the outlet end of the fluid conduit 43 and the inner wall of the vaporization tube 46 and/or increase the discharge angle relative to the central longitudinal axis of the vaporization tube so as to further expose the sample liquid to the heat of the vaporization tube 46.

Figure 2F:
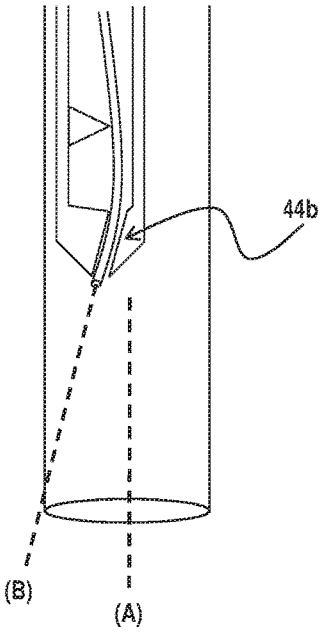

With reference now to FIG. 2F, another exemplary configuration for generating an asymmetric sample spray in accordance with various aspects of the present teachings is depicted. As shown, the fluid conduit 43 exits the sampling probe 42 at a non-parallel angle relative to the central longitudinal axis of the vaporization tube 46 as in FIGS. 2D and 2F, but differs in that the channel 44*b* through which the fluid conduit 43 extends through the distal end of the sheath 44 (i.e., the sampling probe's outlet end 42*b*) also extends at a non-parallel angle relative to the central longitudinal axis (A) of the vaporization tube 46. In this exemplary case, the nebulizer gas as well as the sample liquid can exit the sampling probe 42 substantially along the same discharge axis (B).

Figure 3A:
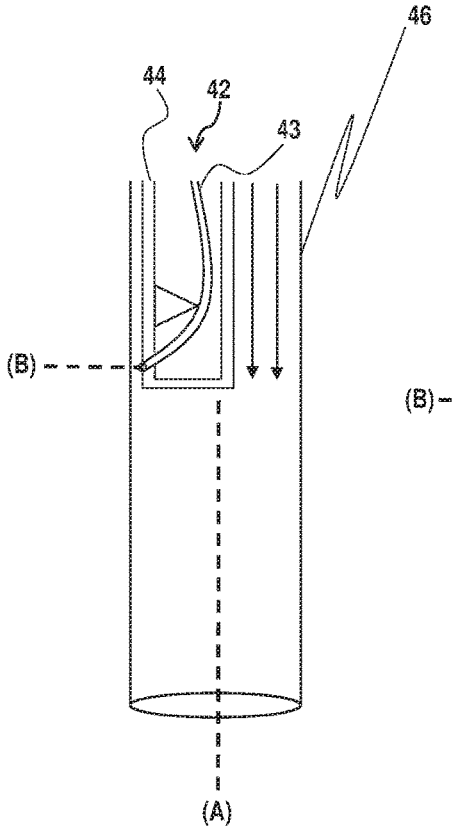
FIGS. 3A-C, in schematic diagram, illustrate exemplary APCI sources in accordance with various aspects of the present teaching for providing an asymmetric sample spray within a vaporization chamber.
Figure 3B:
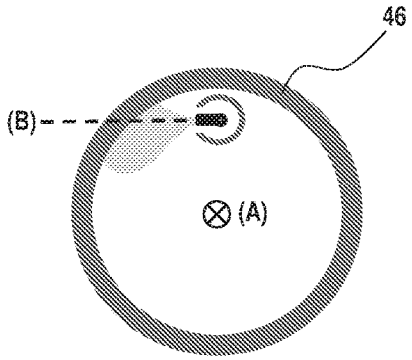
Figure 3C:
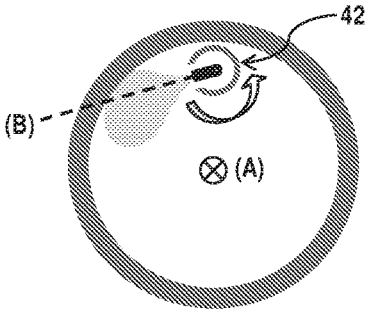

With reference now to FIGS. 3A-C, another exemplary configuration for generating an asymmetric sample spray in accordance with various aspects of the present teachings is depicted. As shown, the fluid conduit 43 is configured to discharge the sample spray within the vaporization tube 46 along an axis (B) that is substantially perpendicular to the central longitudinal axis (A) of the vaporization tube 46. In such aspects, the fluid conduit 43 can exit through a bore in the sidewall of the sheath 44 such that the discharge of the sample spray can follow substantially along a perimeter of the vaporization chamber 46. It will be appreciated that in such aspects, the circumferential component of the flow of the sample spray as the liquid sample traverses the vaporization tube 46 toward the ionization chamber can thus be maximized to generate the spiral flow of the sample. With particular reference to the schematic cross sections FIGS. 3B and 3C, in some aspects, the sampling probe 42 can be adjusted so as to control the discharge axis (B) from the fluid conduit 43 within the vaporization tube 46 so as to maximize the sample ionization efficiency. By way of example, as indicated by the arrow in FIG. 3C, the sampling probe 42 can be rotated (e.g., counter-clockwise) relative to the configuration in FIG. 3B so as to increase the spiral nature of the flow in a collimated, localized path along the wall such that the heated gas plume exits the vaporization tube 46 in a small section of the chamber's exit aperture. Additionally or alternatively, in some aspects, the sampling probe 42 can be adjusted longitudinally such that the flow preferentially exits the vaporization tube 46 adjacent to a charge source (e.g., corona discharge needle) to enhance the ionization efficiency. Thus, in various aspects, it will be appreciated that the positioning and/or angle of the fluid conduit 43 and/or the sampling probe 42 can be adjusted (e.g., varied) to obtain maximum ionization efficiency.

Those having ordinary skill in the art will appreciate that various changes can be made to the above embodiments without departing from the scope of the invention. All such modifications or variations are believed to be within the sphere and scope of the applicants' teachings as defined by the claims appended hereto.

The invention claimed is:

1. An atmospheric pressure chemical ionization source for a mass spectrometer, comprising:

a heated vaporization tube defining a lumen extending from a vaporization tube inlet end to a vaporization tube outlet end along a central longitudinal axis, the vaporization tube outlet end configured to be disposed within an ion source housing in fluid communication with a sampling orifice of the mass spectrometer;

a sampling probe comprising a liquid conduit extending from a liquid conduit inlet end configured to receive a liquid sample comprising solvent molecules and sample molecules to a liquid conduit outlet end disposed within the lumen of the heated vaporization tube between the vaporization tube inlet end and the vaporization tube outlet end, said sampling probe further comprising a gas conduit at least partially surrounding the liquid conduit for providing a nebulizing gas about the liquid sample discharged from the liquid conduit outlet end, the sampling probe further comprising a dimple formed on an inner sidewall of the gas conduit that at least partially surrounds the liquid conduit to deflect the liquid conduit such that the liquid discharged from the liquid conduit is directed along at a sidewall of the heated vaporization tube, wherein the liquid conduit outlet end is configured to discharge the liquid sample into a sample spray exhibiting a central axis that is not coaxial with the central longitudinal axis of the lumen, wherein the heated vaporization tube is configured to vaporize at least a portion of said solvent molecules and sample molecules as the sample spray traverses the lumen toward the vaporization tube outlet end, a gas source coupled to said heated vaporization tube for introducing an entrainment flow of gas between an outer surface of the sampling probe and an inner wall of the heated vaporization tube into the vaporization tube so as to promote asymmetric flow of the sample spray within the heated vaporization tube and to inhibit back streaming of the sample spray; and a charge source disposed adjacent to the vaporization tube outlet end configured to apply an electric charge to the vaporized solvent molecules and sample molecules as said vaporized solvent molecules and sample molecules exit from the vaporization tube outlet end into the ion source housing so as to ionize the sample molecules within the ion source housing.

2. The device of claim 1, further comprising a gas source configured to provide a gas flow about the sampling probe to direct the liquid sample discharged from the sampling probe toward the inner sidewall of the heated vaporization tube.

3. The device of claim 1, wherein the central axis of the sample spray intersects the heated vaporization tube.

4. The device of claim 1, wherein at least the liquid conduit outlet end extends along a longitudinal axis that intersects the heated vaporization tube.

5. The device of claim 1, wherein the vaporization tube is configured to be heated to a temperature in a range of about 100° C. to about 750° C.

6. The device of claim 1, wherein the charge source comprises a corona discharge needle.

7. The device of claim 1, wherein the heated vaporization tube and the sampling probe are configured such that the vaporized solvent molecules and sample molecules preferentially exit the heated vaporization tube from a side of the lumen's central longitudinal axis.

8. The device of claim 7, wherein the charge source comprises a discharge needle that is disposed adjacent to the vaporization tube outlet end on said side from which said vaporized solvent molecules and sample molecules preferentially exit.

9. A method of ionizing sample molecules within a liquid sample, comprising:

providing a heated vaporization tube defining a lumen extending from a vaporization tube inlet end to a vaporization tube outlet end along a central longitudinal axis, the vaporization tube outlet end configured to be disposed within an ion source housing in fluid communication with a sampling orifice of a mass spectrometer, providing a sampling probe comprising a liquid conduit extending from a liquid conduit inlet end configured to receive a liquid sample comprising solvent molecules and sample molecules to a liquid conduit outlet end disposed within the lumen of the heated vaporization tube between the vaporization tube inlet end and the vaporization tube outlet end, said sampling probe further comprising a gas conduit at least partially surrounding the liquid conduit for providing a nebulizing gas about the liquid sample discharged from the liquid conduit outlet end, wherein a dimple formed on an inner sidewall of the gas conduit that at least partially surrounds the liquid conduit deflects the liquid conduit such that the liquid discharged from the liquid conduit is directed along at a sidewall of the heated vaporization tube, discharging the liquid sample from the liquid conduit outlet end into the lumen of the heated vaporization tube, wherein the lumen of the heated vaporization tube extends along a central longitudinal axis, wherein the liquid sample is discharged as a sample spray exhibiting a central axis that is not coaxial with the central longitudinal axis of the lumen;

vaporizing at least a portion of solvent molecules and sample molecules within the liquid sample as the sample spray traverses the lumen toward the vaporization tube outlet end;

introducing an entrainment flow of gas into the vaporization tube so as to promote asymmetric flow of the sample spray within the heated vaporization tube and to inhibit back streaming of the sample;

applying an electrical charge to at least one of the vaporized solvent molecules and sample molecules as they exit the vaporization tube outlet end into an ionization chamber such that the sample molecules are ionized within the ionization chamber;

transmitting the ionized sample molecules from the ionization chamber into the sampling orifice of the mass spectrometer; and performing mass spectrometric analysis of the ionized sample molecules.

10. The method of claim 9, wherein the ionization chamber is maintained at substantially atmospheric pressure.

11. The method of claim 9, wherein the gas flow is configured to maintain the liquid sample discharged from the sampling probe toward the inner wall of the heated vaporization tube on the side of the central longitudinal axis on which the sample spray is offset.

12. The method of claim 9, wherein the central axis of the sample spray as the sample spray exits the sampling probe intersects the heated vaporization tube.

13. The method of claim 9, further comprising maintaining the heated vaporization tube at a temperature in a range of about 100° C. to about 750° C.

14. The method of claim 9, wherein the vaporized solvent molecules and sample molecules preferentially exit the heated vaporization tube from one side of the lumen's central longitudinal axis.

15. The method of claim 14, wherein the electrical charge is applied by a charge source disposed adjacent to the vaporization tube outlet end on said side from which said vaporized solvent molecules and sample molecules preferentially exit from the heated vaporization tube.

16. The atmospheric pressure chemical ionization source of claim 1, wherein said liquid conduit is configured to discharge the liquid sample along an axis that is substantially perpendicular to said central longitudinal axis of the heated vaporization tube.

17. The atmospheric pressure chemical ionization source of claim 1, wherein said liquid conduit is configured to discharge the liquid sample such that the discharged sample will follow substantially along a perimeter of the heated vaporization tube.

18. The atmospheric pressure chemical ionization source of claim 1, wherein the sampling probe is rotatable so as to adjust an axis along which the sample is discharged into said heated vaporization tube.

19. An atmospheric pressure chemical ionization source for a mass spectrometer, comprising:

a heated vaporization tube defining a lumen extending from a vaporization tube inlet end to a vaporization tube outlet end along a central longitudinal axis, the vaporization tube outlet end configured to be disposed within an ion source housing in fluid communication with a sampling orifice of the mass spectrometer;

a sampling probe extending from a liquid conduit inlet end configured to receive a liquid sample comprising solvent molecules and sample molecules to a liquid conduit outlet end disposed within the lumen of the heated vaporization tube between the vaporization tube inlet and the vaporization tube outlet end, said sampling probe further comprising a gas conduit at least partially surrounding the liquid conduit for providing a nebulizing gas about the liquid sample discharged from the outlet end of the liquid conduit, wherein said gas conduit at least partially surrounding the liquid conduit comprises a bore in a sidewall thereof through which the liquid sample is discharged such that the discharged liquid sample can follow substantially along a perimeter of the heated vaporization tube, wherein the liquid conduit outlet end is configured to discharge the liquid sample into a sample spray exhibiting a central axis that is not coaxial with the central longitudinal axis of the lumen, wherein the heated vaporization tube is configured to vaporize at least a portion of said solvent molecules and sample molecules as the sample spray traverses the lumen toward the vaporization tube outlet end, a gas source coupled to said heated vaporization tube for introducing an entrainment flow of gas between an outer surface of the sampling probe and an inner wall of the heated vaporization tube into the vaporization tube so as to promote asymmetric flow of the sample spray within the heated vaporization tube and to inhibit back streaming of the sample spray; and a charge source disposed adjacent to the vaporization tube outlet end configured to apply an electric charge to the vaporized solvent molecules and sample molecules as said vaporized solvent molecules and sample molecules exit from the vaporization tube outlet end into the ion source housing so as to ionize the sample molecules within the ion source housing.

20. A method of ionizing sample molecules within a liquid sample, comprising:

providing a heated vaporization tube defining a lumen extending from a vaporization tube inlet end to a vaporization tube outlet end along a central longitudinal axis, the vaporization tube outlet end configured to be disposed within an ion source housing in fluid communication with a sampling orifice of a mass spectrometer, providing a sampling probe comprising a liquid conduit extending from a liquid conduit inlet end configured to receive a liquid sample comprising solvent molecules and sample molecules to a sampling probe outlet end disposed within the lumen of the heated vaporization tube between the vaporization tube inlet end and the vaporization tube outlet end, said sampling probe further comprising a gas conduit at least partially surrounding the liquid conduit for providing a nebulizing gas about the liquid sample discharged from the liquid conduit outlet end, wherein said gas conduit at least partially surrounding the liquid conduit comprises a bore in a sidewall thereof through which the liquid sample is discharged such that the discharged liquid sample can follow substantially along a perimeter of the heated vaporization tube, discharging the liquid sample from the liquid conduit outlet end into the lumen of the heated vaporization tube, wherein the lumen of the heated vaporization tube extends along a central longitudinal axis, wherein the liquid sample is discharged as a sample spray exhibiting a central axis that is not coaxial with the central longitudinal axis of the lumen;

vaporizing at least a portion of solvent molecules and sample molecules within the liquid sample as the sample spray traverses the lumen toward the vaporization tube outlet end;

introducing an entrainment flow of gas into the vaporization tube so as to promote asymmetric flow of the sample spray within the heated vaporization tube and to inhibit back streaming of the sample;

applying an electrical charge to at least one of the vaporized solvent molecules and sample molecules as they exit the vaporization tube outlet end into an ionization chamber such that the sample molecules are ionized within the ionization chamber;

transmitting the ionized sample molecules from the ionization chamber into the sampling orifice of the mass spectrometer; and performing mass spectrometric analysis of the ionized sample molecules.

* * * * *